US007854966B2

(12) United States Patent
Nardi

(10) Patent No.: US 7,854,966 B2
(45) Date of Patent: Dec. 21, 2010

(54) COATING PROCESS FOR FATIGUE CRITICAL COMPONENTS

(75) Inventor: Aaron T. Nardi, East Granby, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1355 days.

(21) Appl. No.: 11/349,321

(22) Filed: Feb. 6, 2006

(65) Prior Publication Data

US 2007/0184297 A1 Aug. 9, 2007

(51) Int. Cl.

| | |
|---|---|
| ***C23C 14/00*** | (2006.01) |
| ***C23C 16/00*** | (2006.01) |
| ***C23C 20/00*** | (2006.01) |
| ***C23C 18/00*** | (2006.01) |
| ***C23C 22/00*** | (2006.01) |
| ***C23C 4/00*** | (2006.01) |

(52) U.S. Cl. ..... 427/405; 427/419.7

(58) Field of Classification Search ..... 427/404, 427/405, 419.1, 419.7

See application file for complete search history.

(56) References Cited

U.S. PATENT DOCUMENTS

| | | | | | |
|---|---|---|---|---|---|
| 3,615,370 | A * | 10/1971 | Ridal et al. | ..... | 420/106 |
| 3,951,612 | A | 4/1976 | Gates et al. | | |
| 4,478,638 | A * | 10/1984 | Smith et al. | ..... | 75/255 |
| 4,813,608 | A * | 3/1989 | Holowach et al. | ..... | 239/265.37 |
| 5,033,579 | A | 7/1991 | Vanderstraeten | | |
| 2003/0064234 | A1 * | 4/2003 | Payne et al. | ..... | 428/469 |

FOREIGN PATENT DOCUMENTS

| | | | | |
|---|---|---|---|---|
| EP | 0 526 670 | | | 2/1993 |
| JP | 55058360 | A | | 5/1980 |
| JP | 62-211387 | | | 9/1987 |
| JP | 4-59979 | | | 2/1992 |
| JP | 08-074504 | A | * | 9/1994 |
| JP | 8-74504 | | | 3/1996 |
| JP | 9272987 | A | | 10/1997 |
| JP | 10030163 | A | | 2/1998 |
| JP | 10081949 | A | | 3/1998 |
| JP | 2006070297 | A | | 3/2006 |

OTHER PUBLICATIONS

M.M. Lima et al.; "Coating fracture toughness determined by Vickers indentation: an important parameter in cavitation erosion resistance of WC-Co thermally sprayed coatings"; Surface and Coatings Technology; vol. 177-178, 2004; pp. 489-496.

C. Godoy et al.; "Correlation between residual stresses and adhesion of plasma sprayed coatings: effects of a post-annealing treatment"; Thin Solid Films; vol. 420-421, 2002; pp. 438-445.

* cited by examiner

*Primary Examiner*—William Phillip Fletcher, III
(74) *Attorney, Agent, or Firm*—Bachman & LaPointe, P.C.

(57) ABSTRACT

A coating process for fatigue critical components is provided. The coating process comprises the steps of providing a substrate having a first modulus of elasticity, depositing a layer of a material having a second modulus of elasticity less than the first modulus of elasticity onto the substrate, and depositing a coating over the material layer.

6 Claims, 4 Drawing Sheets

COATING PROCESS FOR FATIGUE CRITICAL COMPONENTS

BACKGROUND OF THE INVENTION (1) Field of the Invention

The present invention relates to a coating process for a fatigue critical component and to a part formed thereby.

(2) Prior Art

The technology of duplex thermal spray coatings has been used for years to build up worn parts used in engines, propellers, and other applications where greater than 0.010 inches of build up is required, or in situations where a bond coat is required because the desired topcoat will not bond properly to the substrate. Tests have been conducted to identify failure modes of fatigue sensitive parts used in highly loaded applications and on which very hard wear resistant coatings are applied. Structural aluminum and titanium alloys have been found to be very sensitive to these hard coatings while steel alloys are somewhat less sensitive. These tests suggest that the high bond and cohesive strength of coatings like tungsten carbide and other cermets allow the coating to behave like the substrate. These coatings resist strain and have a modulus of elasticity equal to or greater than steel, but are brittle materials like ceramics. When a crack forms in a coating of this integrity, that crack can act just like a crack in the substrate and propagate as the theories of fracture mechanics dictate. FIGS. 1-3 show the typical crack propagation from a hard coating 10 into the softer, lower modulus structural substrate 12. As shown in FIG. 1, the crack 14 initiates in the hard, high modulus coating due to fatigue or overload. As shown in FIG. 2, the crack 14 propagates through the coating 10 and directly into the substrate 12. FIG. 3 illustrates a crack 14 extending from a tungsten carbide—17 wt % cobalt coating into a substrate formed from aluminum alloy 7075-T73.

This problem occurs in all structural materials with lower strain threshold coatings (coatings which crack with a relatively low static strain applied), but often can be avoided with very high strain threshold coating materials on steel because the modulus of elasticity of steel is so high that very high substrate stresses are required in order to generate cracks. Aluminum and titanium are still susceptible to fatigue with high strain threshold coatings due to the low modulus of elasticity of the substrate, and in the case of aluminum, the high coefficient of thermal expansion (CTE). The CTE plays a role in parts that see elevated temperatures because the CTE of most wear resistant coatings are very low. This forces a strain in the coating just due to thermal cycling, which may cause the coating to crack.

SUMMARY OF THE INVENTION

In accordance with the present invention, there is provided a coating process for fatigue critical components. The process broadly comprises the steps of providing a substrate having a first modulus of elasticity, depositing a layer of a material having a second modulus of elasticity less than the first modulus of elasticity onto the substrate, and depositing a coating over the material layer.

Further, in accordance with the present invention, there is provided a part which broadly comprises a substrate, a wear coating deposited over the substrate, the coating being brittle and susceptible to cracks, and a crack halting layer separating the substrate from the wear coating.

Still further in accordance with the present invention, there is provided a part having improved resistance to cracking. The part broadly comprises a substrate and a coating deposited on the substrate, and means intermediate the substrate and the coating for preventing cracks developing in the coating from propagating into the substrate.

Other details of the coating process for fatigue critical components, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
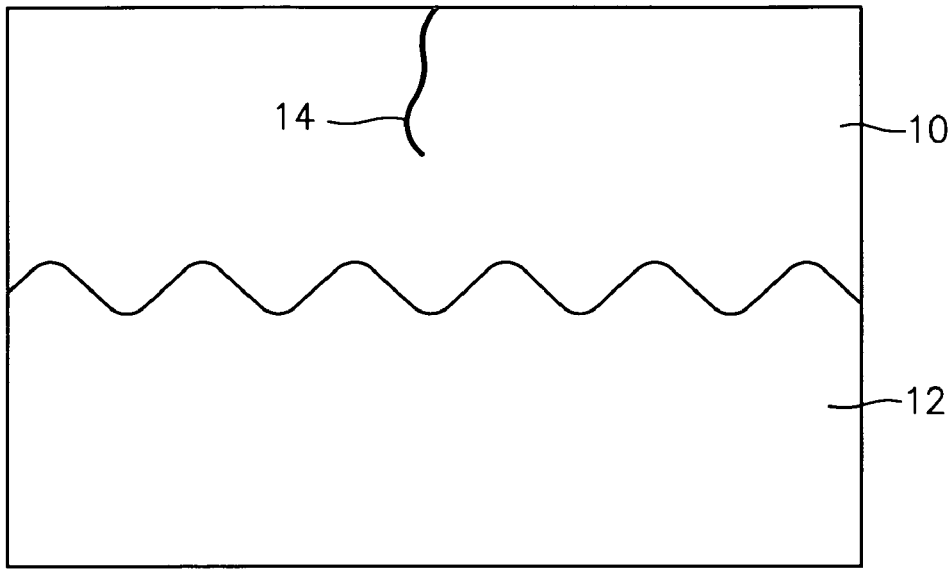
FIG. 1 is a schematic representation of a crack initiating in a coating due to fatigue or overload.
Figure 2:
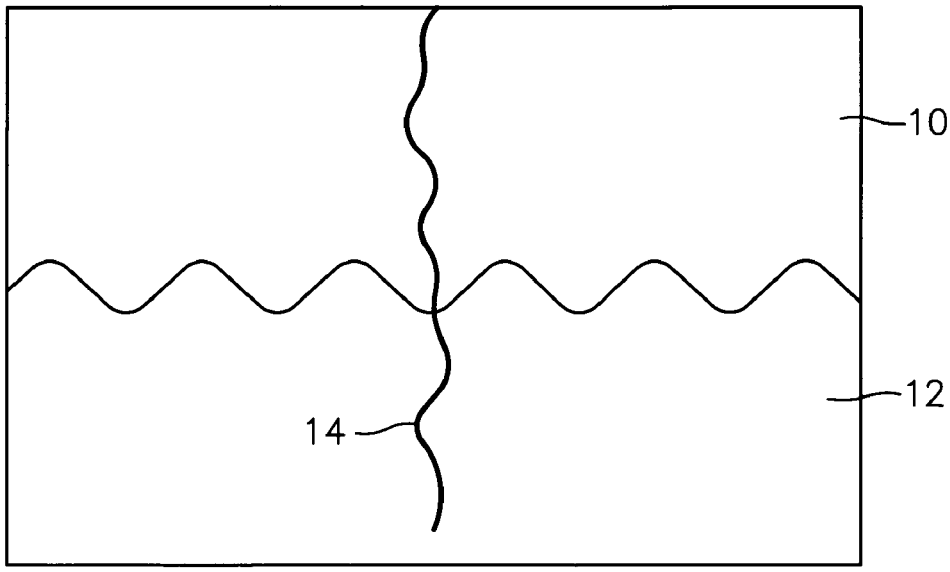
FIG. 2 is a schematic representation of crack propagation through a coating and directly into a substrate.
Figure 3:
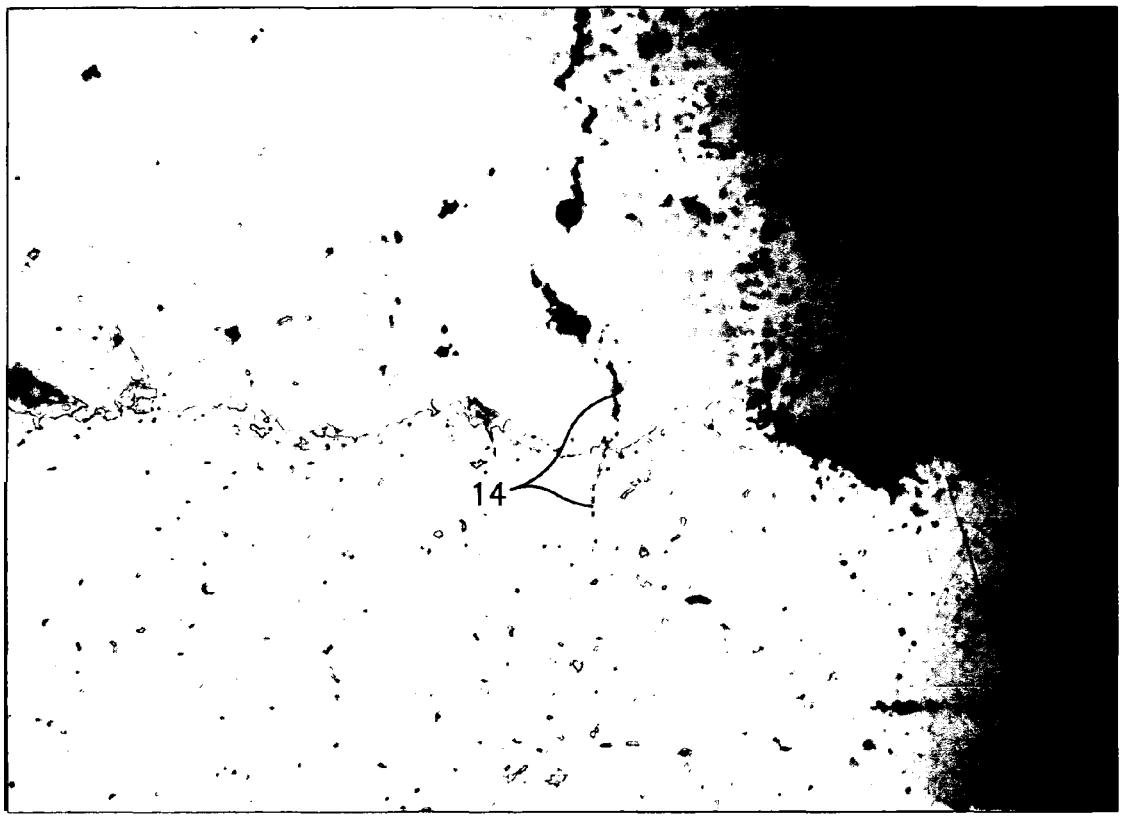
FIG. 3 is a photomicrograph of cracking from a tungsten carbide coating into an aluminum substrate.
Figure 4:
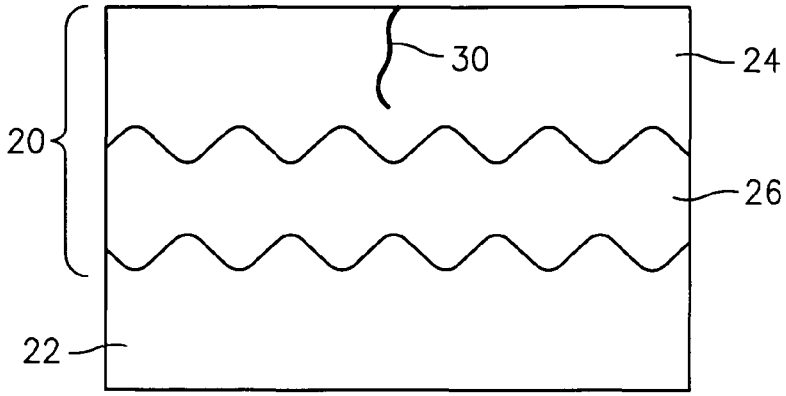
FIG. 4 is a schematic representation of a coating system in accordance with the present invention.

Referring now to FIG. 4, there is shown a coating system 20 in accordance with the present invention deposited onto a substrate 22. The substrate may be formed from any suitable metallic material known in the art. For example, the substrate 22 could be a metallic material selected from the group consisting of aluminum, aluminum alloys, steel, titanium, and titanium alloys. The substrate 22 has a first modulus of elasticity. The coating system 20 further includes a hard coating 24, such as one formed from tungsten carbide, having a modulus of elasticity higher than the modulus of elasticity of the material forming the substrate 22. The hard coating 24 is preferably a wear resistant coating. The coating system 20 further includes a crack halting layer 26. The crack halting layer 26 may be formed using any suitable material known in the art having a modulus of elasticity which is less than the modulus of elasticity of the hard coating 24 and less than the modulus of elasticity of the material forming the substrate 22. For example, the crack halting layer 26 may be formed from aluminum, an aluminum based alloy such as Al-12% Si or Al 6061 which has a composition consisting of 1% Mg, 0.6% Si, 0.28% Cu, 0.2% Cr, or a nickel based alloy, such as INCONEL 718 which has a composition consisting of 19 wt % chromium, 3.05 wt % molybdenum, up to 1.0 wt % max cobalt, 5.13 wt % columbium+tantalum, 0.9 wt % titanium, 0.5 wt % aluminum, 18.5 wt % iron, and the balance nickel.

The crack halting layer 26 may be deposited on the substrate 22 using any suitable deposition technique known in the art such as High Velocity Oxygen Fuel (HVOF), Plasma Spray, Twin Wire Arc Spray, Cold Spray, Electrolytic deposition plating, electroless deposition plating or another coating method capable of applying coatings which meet the requirements defined herein. Similarly, the hard coating layer 24 may be deposited onto the crack halting layer 26 using any suitable deposition technique known in the art. Deposition techniques which may be used include High Velocity Oxygen Fuel, Plasma Spray, Twin Wire Arc Spray, Cold Spray, Electrolytic deposition plating, electroless deposition plating and any other coating method capable of applying coatings which meet the requirements defined herein. The thickness of the crack halting layer 26 must be equal to or greater than the thickness of the hard coating layer 24.

As shown in FIG. 4, a crack 30 may initiate in the hard coating layer 24. The crack may be a result of fatigue and/or overload.

Figure 5:
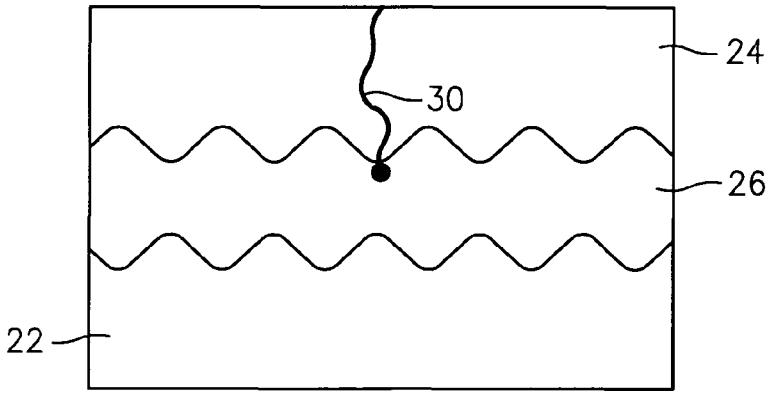
FIG. 5 is a schematic representation of a coating system in accordance with the present invention where a crack propagates into a crack halting layer and is arrested due to crack tip plasticity.

As shown in FIG. 5, the crack 30 may grow into the crack halting layer 26 and may be arrested due to crack tip plasticity.

Figure 6:
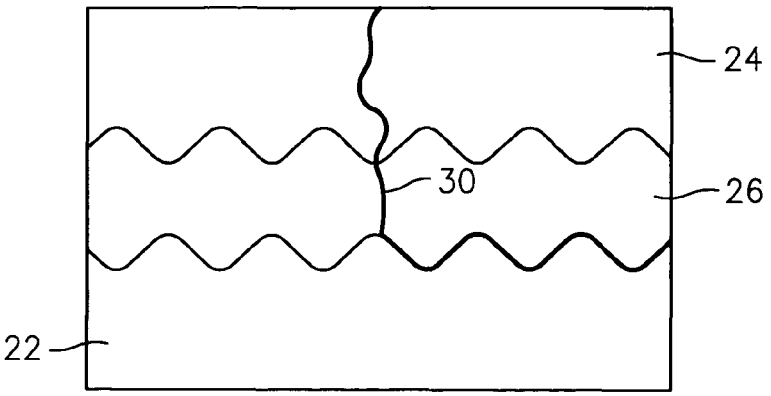
FIG. 6 is a schematic representation of a coating system in accordance with the present invention where a crack propagates through a crack halting layer and changes direction due to modulus differential.

As shown in FIG. 6, the crack 30 may propagate through the crack halting layer 26. At the interface 32 between the crack halting layer 26 and the substrate 22, the crack 30 may change direction due to the differential between the moduli of elasticity of the crack halting layer 26 and the substrate 22.

Figure 7:
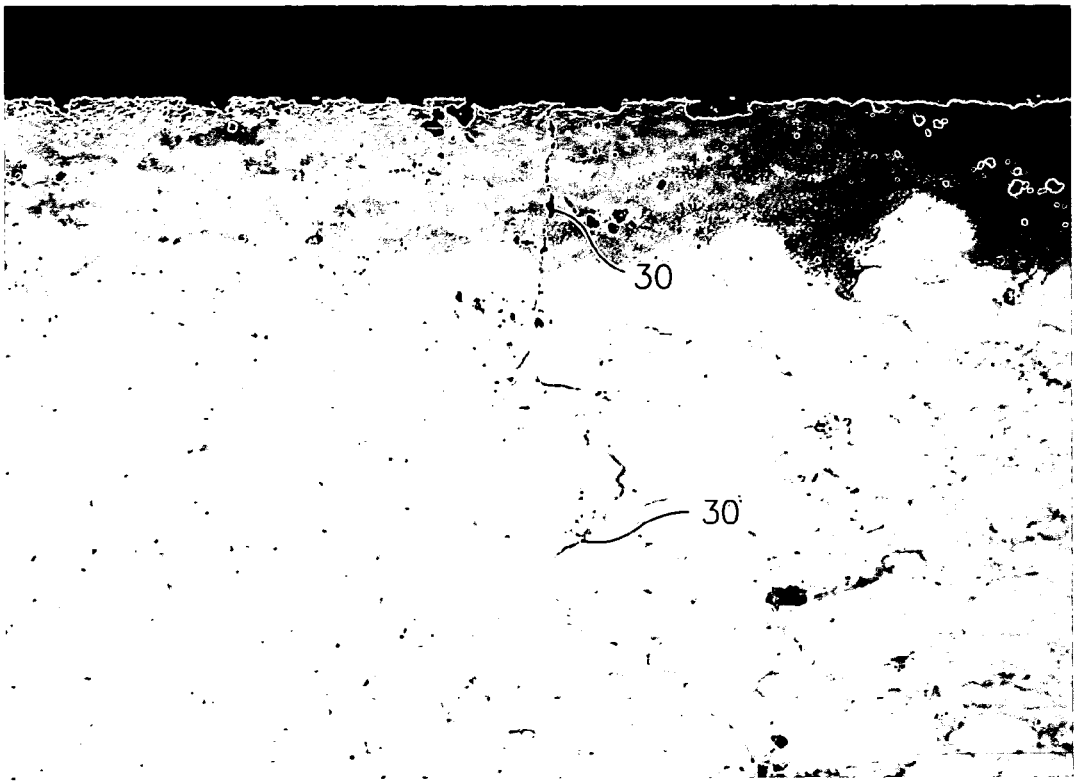
FIG. 7 is a photomicrograph showing a crack propagating in the hard coating but being arrested by the crack halting layer.
Figure 8:
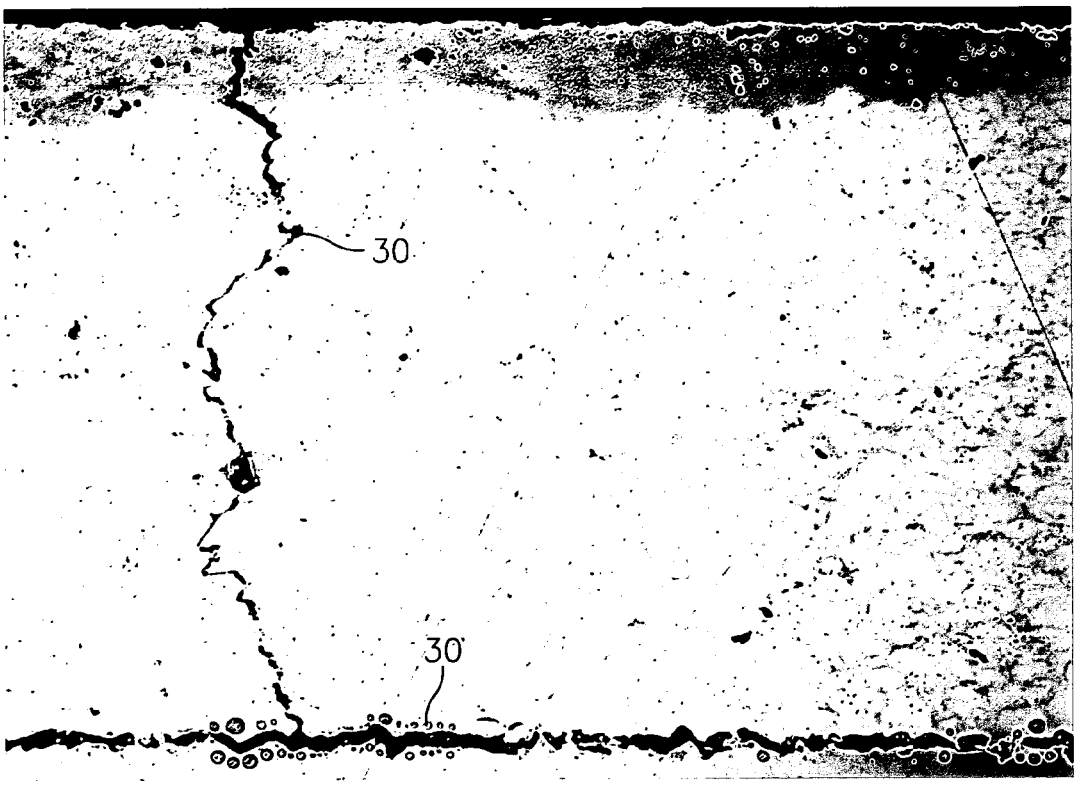
FIG. 8 is a photomicrograph showing a crack propagating in the hard coating, passing through the crack halting layer, and changing direction at the substrate interface.

To demonstrate the present invention, high strength steel D6AC steel components were coated with a layer of INCONEL 718 having a thickness of 0.025 inches. A layer of hard tungsten carbide (WC-17 wt % Co) having a thickness of 0.005 inches was applied on top of the INCONEL 718. Testing was performed to identify the static strain threshold and the fatigue limit of the coating. Once the coating cracked, the crack propagated into the INCONEL layer, but did not propagate further into the steel substrate. Failure occurred on the steel at a stress level consistent with the typical strength of the steel alloy used, and at a location removed from the site of the initial coating cracking. FIG. 7 illustrates a specimen wherein cracking from the hard coating layer 24 propagates into the crack halting layer 26 where it is arrested. FIG. 8 illustrates a specimen wherein cracking from the hard coating layer 24 propagates into the crack halting layer 26 and changes direction at the substrate interface 34.

The process of the present invention may be used on a wide variety of parts that are coated for wear such as dome cylinders used in connection with propellers and aluminum parts for propulsion systems.

It is apparent that there has been provided in accordance with the present invention a coating process for fatigue critical components which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A coating process for fatigue critical components comprising the steps of:

providing a substrate having a first modulus of elasticity;

depositing a material layer of aluminum or aluminum based alloy having a second modulus of elasticity less than said first modulus of elasticity onto said substrate; and depositing a coating layer consisting solely of a carbide material over and in direct contact with said material layer.

2. The coating process according to claim 1, wherein said substrate providing step comprises providing a substrate formed from a metallic material.

3. The coating process according to claim 1, wherein said substrate providing step comprises providing a substrate formed from a metallic material selected from the group consisting of aluminum, alumimum, alloys, steel, titanium, and titanium alloys.

4. The coating process according to claim 1, wherein said substrate providing step comprises providing a substrate formed from a steel.

5. The coating process according to claim 1, wherein said substrate providing step comprises providing a substrate formed from an aluminum based material.

6. A coating process for fatigue critical components comprising the steps of:

providing a substrate having a first modulus of elasticity;

depositing a layer of a material having a second modulus of elasticity less than said first modulus of elasticity onto said substrate;

depositing a wear coating over said material layer, wherein said substrate providing step comprises providing a substrate formed from a steel, said material layer depositing step comprising depositing a layer of a nickel based alloy, and said wear coating depositing step comprises depositing a layer consisting of tungsten carbide, and wherein said nickel based alloy depositing step comprises depositing a layer of a nickel based alloy containing chromium, molybdenum, columbium+tantalum, titanium, aluminum, and iron.

* * * * *